US007182535B2

(12) United States Patent
Lim

(10) Patent No.: US 7,182,535 B2
(45) Date of Patent: Feb. 27, 2007

(54) COSMETIC VESSEL

(76) Inventor: Heung-Ho Lim, 197-36, Guro-dong, Guro-gu, Seoul (KR) 152-848

( * ) Notice: Subject to any disclaimer, the term of this patent is extended or adjusted under 35 U.S.C. 154(b) by 437 days.

(21) Appl. No.: 10/777,236

(22) Filed: Feb. 12, 2004

(65) Prior Publication Data

US 2005/0092345 A1 May 5, 2005

(30) Foreign Application Priority Data

Nov. 4, 2003 (KR) ..... 10-2003-0077485

(51) Int. Cl.
*A46B 11/00* (2006.01)

(52) U.S. Cl. ..... 401/129; 401/126; 401/122

(58) Field of Classification Search ..... 401/121, 401/122, 126, 128, 129, 130
See application file for complete search history.

(56) References Cited

U.S. PATENT DOCUMENTS 5,697,720 A * 12/1997 Lhuisset ..... 401/122
6,010,265 A * 1/2000 Bouix ..... 401/122
D483,676 S 12/2003 Lee

* cited by examiner

*Primary Examiner*—David J. Walczak
(74) *Attorney, Agent, or Firm*—Richard M. Goldberg

(57) ABSTRACT

A cosmetic vessel of a cosmetic product, includes a vessel body, a plug packing fitted into an upper portion of the vessel body, and a cap threadably engaged to the upper portion of the vessel body. The plug packing has a plurality of L-shaped walls provided by predetermined intervals at a lower portion thereof, a plurality of vent holes formed between the L-shaped walls, and a passage hole with a predetermined diameter and extended to the L-shaped walls to allow a brush-ended shaft of the cap to be placed into or removed from the vessel body. The cap includes a closing part mounted on a bottom thereof and having a hollow interior, a shaft extending downwardly from the closing part with an upper end fitted in the hollow interior of the closing part, and a brush provided to a lower end of the shaft.

1 Claim, 9 Drawing Sheets

FIG. 4
REPLACEMENT SHEET
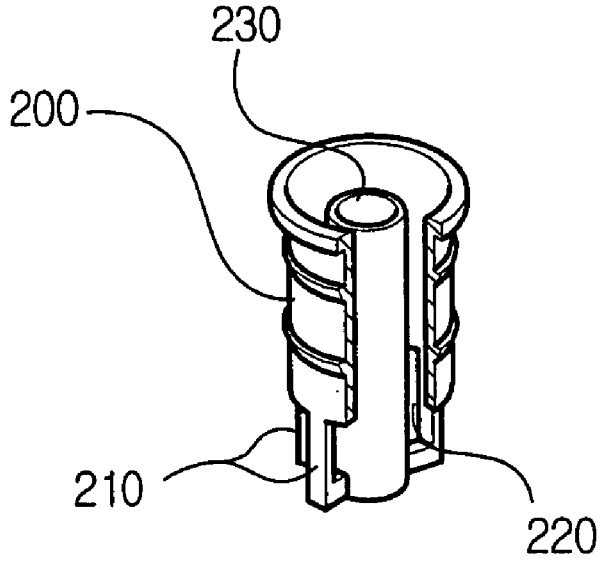

COSMETIC VESSEL

BACKGROUND OF THE INVENTION

1. Field of the Invention

The present invention pertains, in general, to a cosmetic vessel, capable of efficiently using a cosmetic solution of a cosmetic product, such as mascara, eyeliner, lip gloss or manicure, in a proper amount. More specifically, the present invention is directed to a cosmetic vessel, characterized in that air can be suitably introduced into the cosmetic vessel, whereby an applicator brush can be easily placed into or removed from the vessel, and as well, a proper amount of a cosmetic solution can adhere to the applicator brush upon removing the brush from the cosmetic vessel.

2. Description of the Related Art

In general, cosmetic products for use in increasing the beauty of females are exemplified by mascara, eyeliner, lip gloss, etc. As well, their topical body parts, such as fingernails and toenails, are known to be manicured to express various aesthetic desires.

In such cases, cosmetic vessels of the cosmetic products are structured to integratedly provide a shaft ended with an applicator brush to an internal upper portion of a cap so that the brush of the cap is immersed into a cosmetic solution in the vessel. Hence, according to opening or closing the cap of the cosmetic vessel, the cosmetic solution adhering to the brush of the cap is used.

As for a conventional cosmetic vessel, for example, a mascara vessel, a structure thereof to use a cosmetic solution adhering to an applicator brush of a cap by separating the cap integrated with a shaft and such a brush from the cosmetic vessel is improved to further include a plug packing made of an elastic material, such as rubber or silicone, so that the cosmetic solution can be prevented from adhering to an unnecessary portion of the shaft of the cap. That is, the plug packing having a passage hole of a predetermined diameter is fitted into the open upper portion of the cosmetic vessel. As such, the passage hole of the plug packing has a diameter almost the same to an outer diameter of the shaft of the cap. Thereby, while the brush-ended shaft of the cap passes through the passage hole of the plug packing upon placing or removing it into or from the cosmetic vessel, the amount of the cosmetic solution adhering to the brush of the cap can be removed.

Such a cosmetic vessel is advantageous in that the use of an excessive amount of the cosmetic solution can be prevented by means of the plug packing, however, since the passage hole of the plug packing is perforated in a predetermined size, the cosmetic solution in the vessel cannot but be in contact with air. Hence, the cosmetic solution exposed to the air is easily solidified, and thus, the entire amount of the cosmetic solution contained in the vessel cannot be used as it is. Further, in addition to the solidification of the cosmetic solution, the passage hole of the plug packing may partially or wholly may adhere with the cosmetic solution solidified partially, and therefore, it is partially or wholly plugged. Eventually, the brush-ended shaft of the cap is difficult to be smoothly placed into or removed from the vessel.

As mentioned above, the passage hole of the plug packing, which is used to allow the brush-ended shaft of the cap to be placed into or removed from the cosmetic vessel, has a diameter almost the same to an outer diameter of the shaft of the cap. Therefore, upon placing the brush-ended shaft of the cap into the cosmetic vessel, air pressure occurs in the cosmetic vessel, and thus, allows the cosmetic solution in the vessel to expand. Consequently, the cosmetic solution cannot properly adhere to the brush of the cap.

Thus, the cap is not tightly fastened to the cosmetic vessel, that is, is loosely fastened thereto, to achieve efficient and complete circulation of the air, so that the cosmetic solution easily adheres to the brush of the cap. However, in the cases where the cap is loosely closed, the inflow of the air into the cosmetic vessel leads to the deterioration or solidification of the cosmetic solution in the vessel, and hence, the cosmetic solution may be often discarded as it is not used completely.

In addition, to use the solidified cosmetic solution, the cosmetic solution may be picked by a pointed tool, such as a toothpick, or the end of the tool may be heated by a lighter and be placed into the vessel so as for adhesion of such a cosmetic solution. However, the above mentioned methods further facilitate the deterioration or solidification of the cosmetic solution in the vessel. As a result, new cosmetic products should be additionally purchased as the cosmetic product such as lip gloss or manicure, which is in use, is not entirely consumed, thus increasing purchasing costs of the cosmetic products.

Therefore, to overcome the above problems, Korean Utility Model Registration No. 242001 discloses a mascara vessel, which is shown in FIGS. 1 and 2.

As shown in FIGS. 1 and 2, the mascara vessel comprises a vessel body 10 having an open upper portion 12, a plug packing 20 having a vertically penetrated passage "D" at a center thereof and fitted into the upper portion 12 of the vessel body 10, a cap 30 fastened to the upper portion 12 of the vessel body 10, a shaft 40 and a brush 50 integrated on a bottom of the cap 30 to be vertically moved along the passage "D" of the plug packing 20. In particular, the plug packing 20 has an incision 20*e* incised to open or close the passage "D" at a predetermined position of the passage "D". Further, the plug packing 20 includes a bellows part 20*d* having symmetrical inclined planes 20*c* which is integratedly formed at a lower portion thereof and has a diameter smaller than that of the upper passage "D". The incision 20*e* of the plug packing 20 is formed in a cross shape at a center of an arc part 20*f* bulged downward from the lower end of the plug packing 20.

Thusly structured mascara vessel is advantageous in that the cosmetic solution can uniformly adhere to the brush of the cap by means of the incision of the plug packing while not adhering to the shaft of the cap.

However, other vent holes, in addition to the incision of the plug packing, are not provided to the above mascara vessel, and thus, air cannot circulate efficiently. Hence, the cosmetic solution in the vessel is difficult to uniformly adhere to the brush of the cap, due to the air present in the cosmetic vessel.

Moreover, when the brush of the cap placed into the vessel is removed from the vessel, the inner pressure of the vessel is instantaneously reduced, whereby a larger amount of the cosmetic solution may adhere to not only the brush of the cap but also the shaft of the cap. In this case, the amount of the cosmetic solution cannot be uniformly controlled through the incision of the plug packing which is formed in the cross shape. Further, upon using the above cosmetic vessel for longer periods, the incision of the plug packing cannot function desirably, due to the solidified cosmetic solution adhering thereto.

SUMMARY OF THE INVENTION

Therefore, it is an object of the present invention to alleviate the problems related to conventional cosmetic vessels containing a cosmetic solution of a cosmetic product, such as mascara, eyeliner, lip gloss or manicure, composed of a brush-ended shaft, and to provide a cosmetic vessel, characterized in that a vent is provided to a plug packing that is fitted into an upper portion of the cosmetic vessel, to allow air to be introduced into a vessel body in a moment, and thus, a cosmetic solution can easily adhere to a brush of a cap upon removing the brush of the cap from the vessel.

To achieve the above object, according to a first embodiment of the present invention, there is provided a cosmetic vessel, comprising a vessel body, a plug packing fitted into an upper portion of the vessel body and having a passage hole with a predetermined diameter, and a cap threadably engaged to the upper portion of the vessel body and having a closing part mounted on a bottom of the cap and having a hollow interior, a shaft extending downwardly from the closing part with an upper end being fitted in the hollow interior of the closing part, and a brush provided to a lower end of the shaft, wherein the plug packing further comprises a plurality of L-shaped walls provided by predetermined intervals at a lower portion thereof, and a plurality of vent holes formed between the L-shaped walls, and the passage hole of the plug packing to allow the shaft and the brush of the cap to be placed into or removed from the vessel body is extended to the L-shaped walls of the plug packing.

According to a second embodiment of the present invention, a cosmetic vessel comprises a plug packing including a passage hole in a center of a bottom of the plug packing to allow a brush and a shaft of a cap to be placed into or removed from a vessel body, and a plurality of vent holes formed around the passage hole.

According to a third embodiment of the present invention, a cosmetic vessel comprises a plug packing including at least one vent channel longitudinally formed on an outer surface of the plug packing.

The cosmetic vessel of the present invention, which is characterized by including vents of the plug packing for the circulation of air, is advantageous in that when the user employs a cosmetic vessel of a cosmetic product, such as mascara, eyeliner, lip gloss, or manicure, air can be introduced into the vessel body through the vents of the cosmetic vessel, whereby a cosmetic solution can uniformly adhere to the brush of the cap. As well, the vents of the plug packing are blocked by the closing part of the cap, and thus, the quality of the cosmetic solution is maintained.

BRIEF DESCRIPTION OF THE DRAWINGS

The above and other objects, features and other advantages of the present invention will be more clearly understood from the following detailed description taken in conjunction with the accompanying drawings, in which:

FIG. 4 is a perspective view of a plug packing which is partially broken away, as a main constitutive part of the cosmetic vessel of FIG. 3;

DETAILED DESCRIPTION OF THE INVENTION

Figure 1:
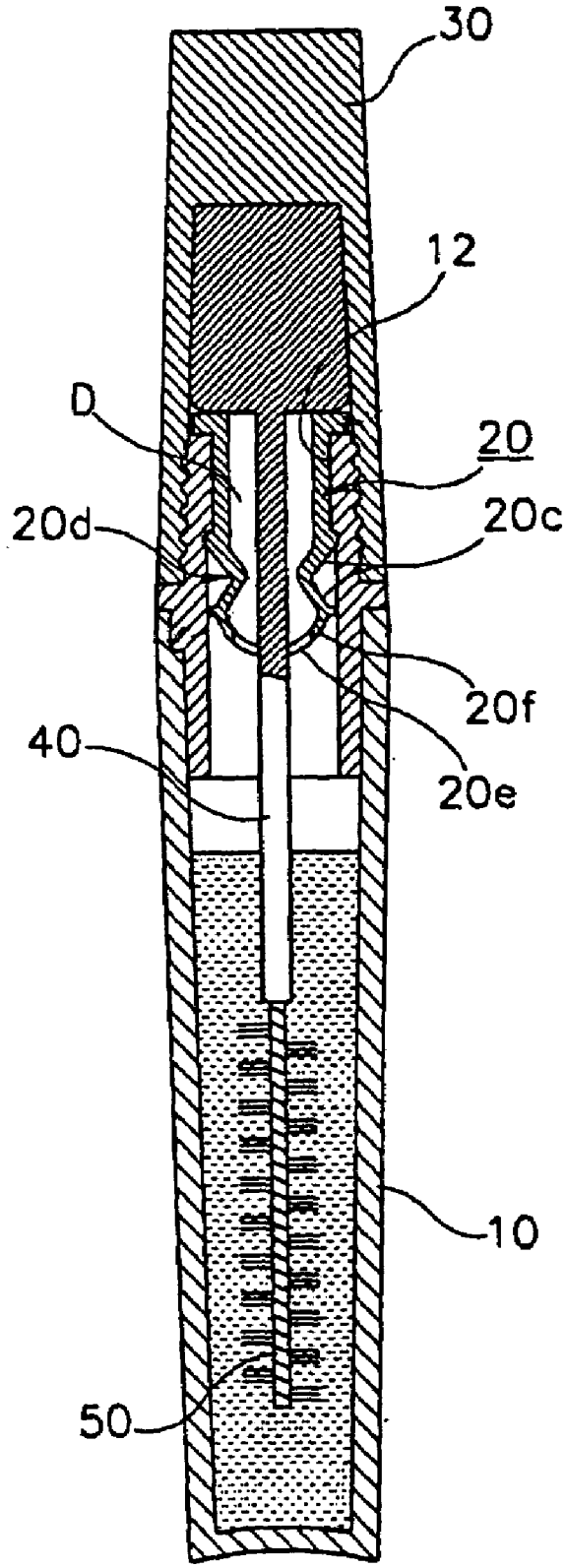
FIG. 1 PRIOR ART
FIG. 1 is a sectional view of a conventional mascara vessel.
Figure 2:
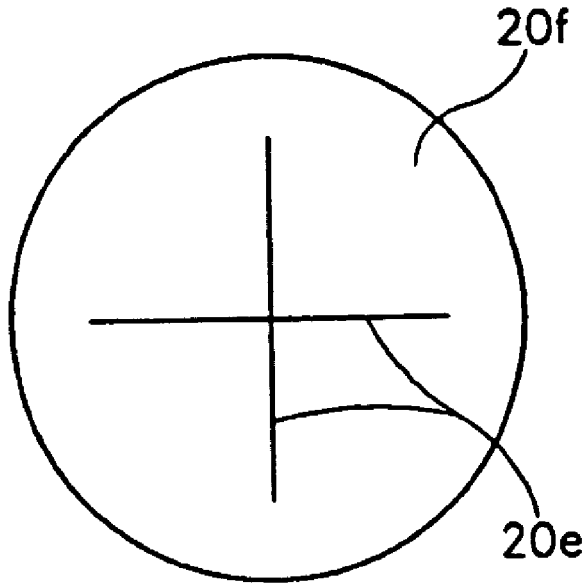
FIG. 2 PRIOR ART
FIG. 2 is a bottom plan view of a plug packing, as a main constitutive part of the mascara vessel of FIG. 1.

Reference should now be made to the drawings, in which the same reference numerals are used throughout the different drawings to designate the same or similar components.

Figure 3:
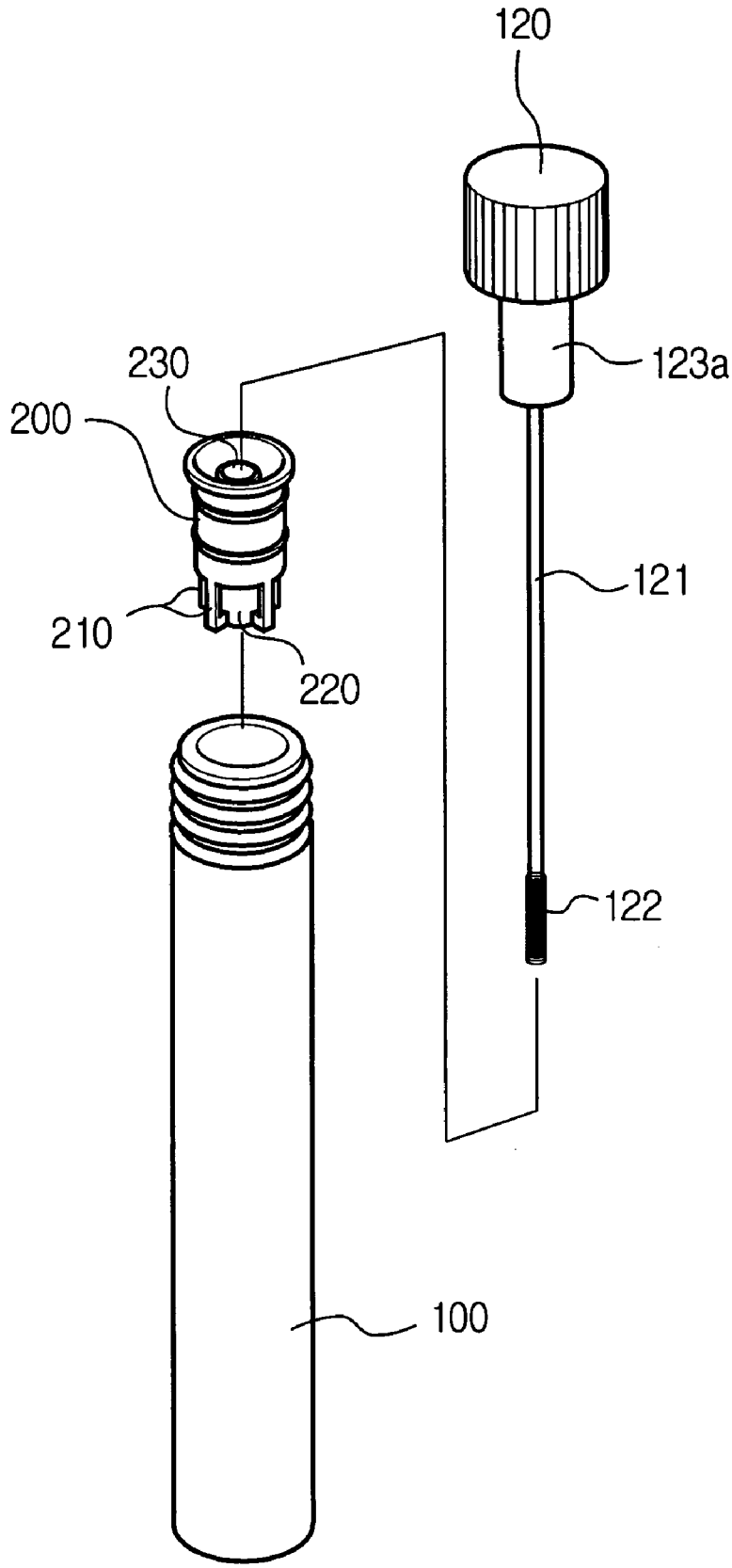
FIG. 3 is an exploded perspective view of a cosmetic vessel, according to a first embodiment of the present invention.
Figure 5:
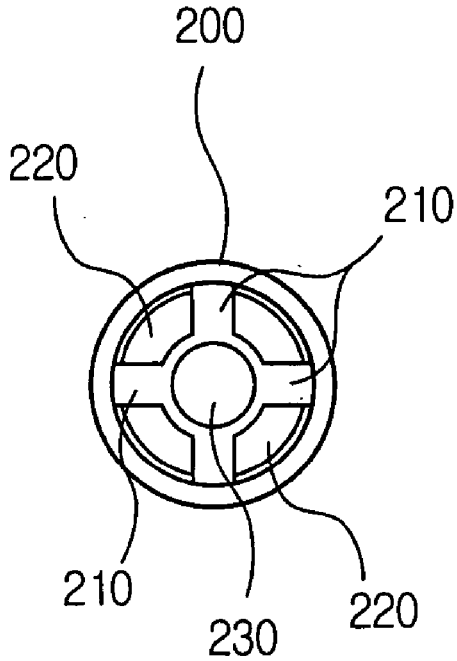
FIG. 5 is a bottom plan view of the plug packing, in the cosmetic vessel of FIG. 3.
Figure 6:
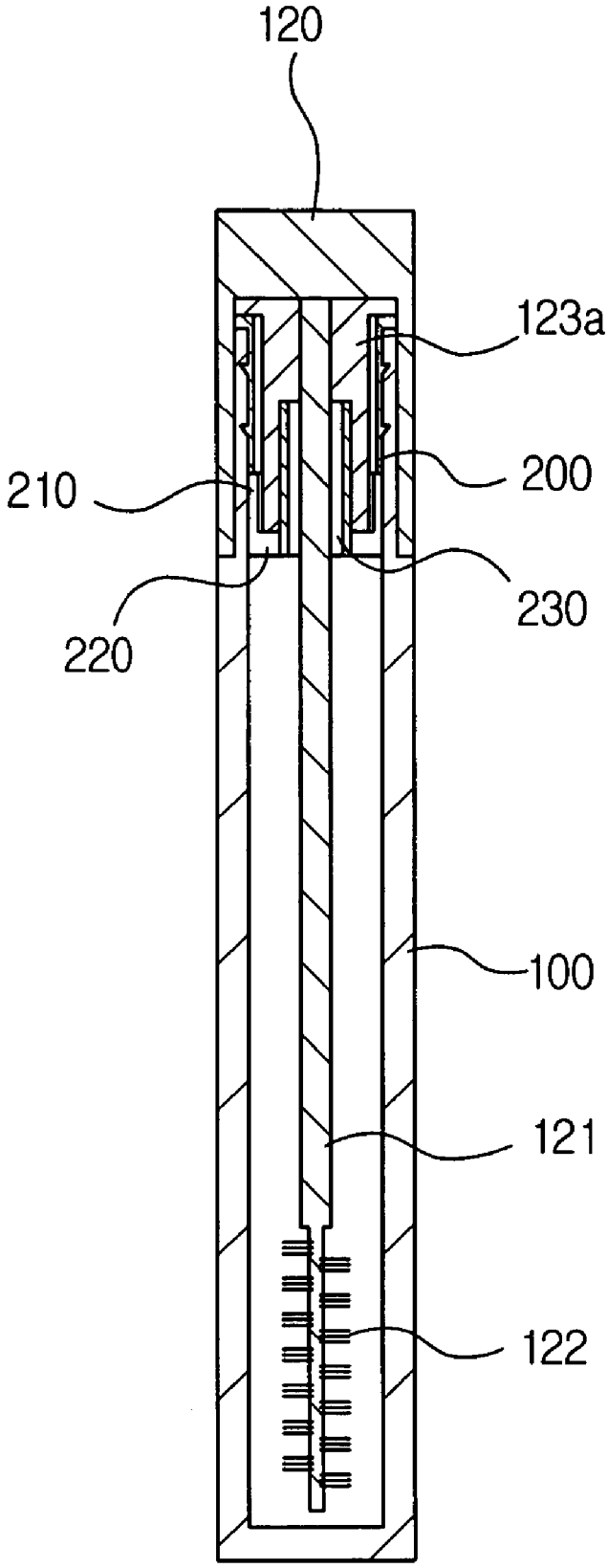
FIG. 6 is a sectional view of the cosmetic vessel of FIG. 3.

FIG. 3 is an exploded perspective view of a cosmetic vessel, according to a first embodiment of the present invention, and FIG. 4 is a perspective view of a plug packing which is partially broken away, as a main constitutive part of the cosmetic vessel of FIG. 3. Further, FIG. 5 is a bottom plan view of the plug packing, in the cosmetic vessel of FIG. 3, and FIG. 6 is a sectional view of the cosmetic vessel of FIG. 3.

As shown in FIG. 3, the cosmetic vessel includes a vessel body 100 containing a cosmetic solution and having an open upper portion, a plug packing 200 fitted into the upper portion of the vessel body 100, and a cap 120 having an internally threaded circumference to be threadably engaged to an externally threaded circumference of the upper portion of the vessel body 100. In such cases, the cap 120 has a shaft 121 extending downwardly therefrom, a brush 122 provided to a lower end of the shaft 121, and a closing part 123*a* fitted in the cap 120 and having a hollow interior.

Further, as seen in FIG. 4, the plug packing 200, which is comprised of a cylindrical body, has a plurality of L-shaped walls 210 provided at a lower portion of the cylindrical body of the plug packing 200 to be circumferentially spaced from each other, and a plurality of vent holes 220 formed between the L-shaped walls 210. Additionally, the plug packing 200 has a passage hole 230 positioned at an inside of the cylindrical body thereof and extended to the L-shaped walls 210 to allow the shaft 121 and the brush 122 of the cap 120 to be placed into or removed from the vessel body 100.

Thusly structured cosmetic vessel is characterized in that, upon removing the shaft 121 and the brush 122 of the cap 120 from the vessel body 100 through the plug packing 200 fitted into the upper portion of the vessel body 100, the cosmetic solution can uniformly adhere to the brush 122 of the cap 120 while not adhering to the shaft 121 of the cap 120.

That is, for the beauty care of the eyelashes or lips of the user, the cap 120 of the cosmetic vessel opens from the vessel body 100, whereby the brush 122 provided at the lower end of the shaft 121 extending downwardly from the cap 120 is removed from the vessel body 100. As such, the cosmetic solution in the vessel body 100 adheres to the brush 122 of the cap 120. Thereby, the cosmetic solution adhering to the brush 122 of the cap 120 is applied to the eyelashes or lips of the user. Meanwhile, when the cap 120 which covers the upper portion of the vessel body 100 is separated from the vessel body 100, the brush 122 of the cap 120 is removed from the vessel body 100 while passing through the passage hole 230 of the plug packing 200. In such cases, the passage hole 230 of the plug packing 200 functions to allow the cosmetic solution to uniformly adhere around the brush 122 of the cap 120. As well, through the vent holes 220 between the L-shaped walls 210 provided at the lower portion of the plug packing 200, air is introduced into the vessel body 100, whereby the cosmetic solution can easily adhere to the brush 122 of the cap 120 upon removing such a brush from the vessel body 100.

After the beauty care of the eyelashes or lips of the user is finished by use of the cosmetic solution adhering to the brush 122 of the cap 120, the cap 120 is threadaly fastened again to the upper portion of the vessel body 100. Thereby, since the vent holes 220 provided to the lower portion of the plug packing 200 are completely blocked by the closing part 123*a* projected from the bottom of the cap 120, the air is not introduced into the vessel body 100, thus preventing deterioration and solidification of the cosmetic solution in the vessel body 100.

Further, the closing part 123*a* of the cap 120 is long formed, together with the passage hole 230 of the plug packing 200 into which the closing part 123*a* of the cap 120 is inserted, whereby the brush 122 ended to the shaft 121 of the cap 120 uniformly adheres with the cosmetic solution while being naturally cleaned upon passing it through the passage hole 230 of the plug packing 200.

However, as for a conventional cosmetic vessel, a plug packing thereof is shortly formed, therefore resulting in that the plug packing easily comes off from the vessel body, or the cap is difficult to be orderly engaged to the vessel body, or the cosmetic solution does not uniformly adhere to the brush of the cap, due to pressure in the cosmetic vessel. On the other hand, in the present invention, since the plug packing of the cosmetic vessel is long formed, the cosmetic solution can uniformly adhere to the brush of the cap, owing to the efficient circulation of air, upon vertically moving the cap for adhesion of the cosmetic solution to the brush of the cap.

Figure 7A:
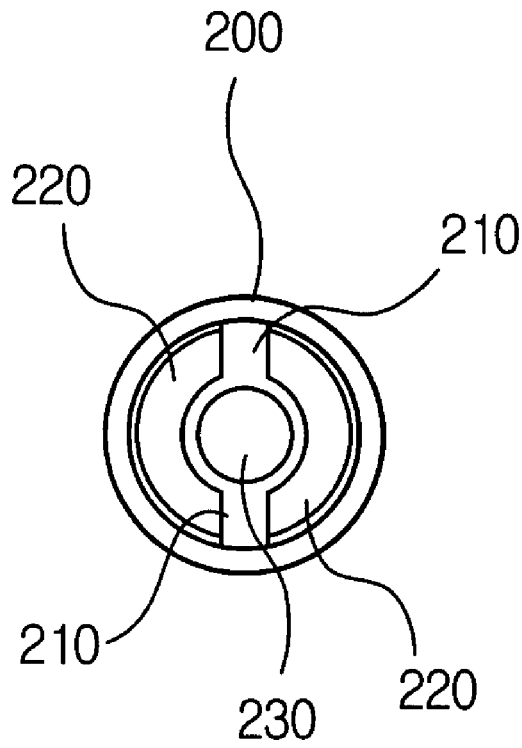
FIG. 7*a* is a bottom plan view of a plug packing in a cosmetic vessel, according to a modification of the first embodiment of the present invention.
Figure 7B:
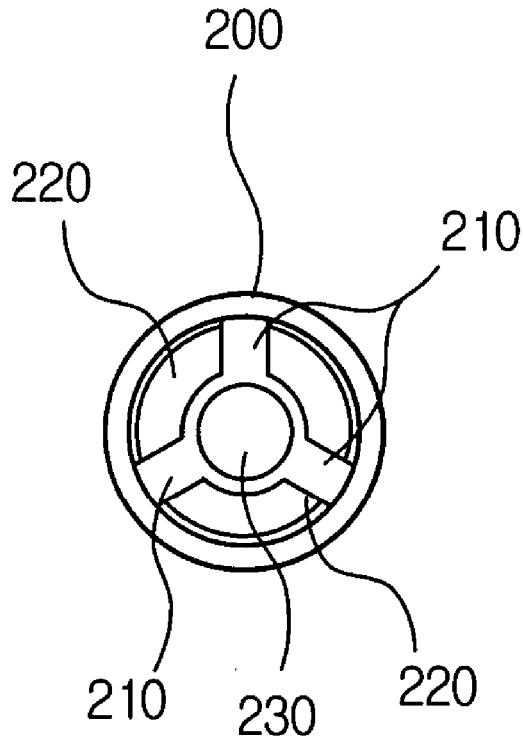
FIG. 7*b* is a bottom plan view of a plug packing in a cosmetic vessel, according to another modification of the first embodiment of the present invention.

FIG. 7*a* is a bottom plan view of a plug packing, in a cosmetic vessel according to a modification of the first embodiment of the present invention, and FIG. 7*b* is a bottom plan view of a plug packing, in a cosmetic vessel according to another modification of the first embodiment of the present invention.

L-shaped walls 210 formed at a lower portion of a plug packing 200, as in FIGS. 7*a* and 7*b*, have different numbers from those of the plug packing 200 of the cosmetic vessel according to the first embodiment of the present invention. That is, the number of the L-shaped walls 210 is not limited so long as it is at least two.

Figure 8:
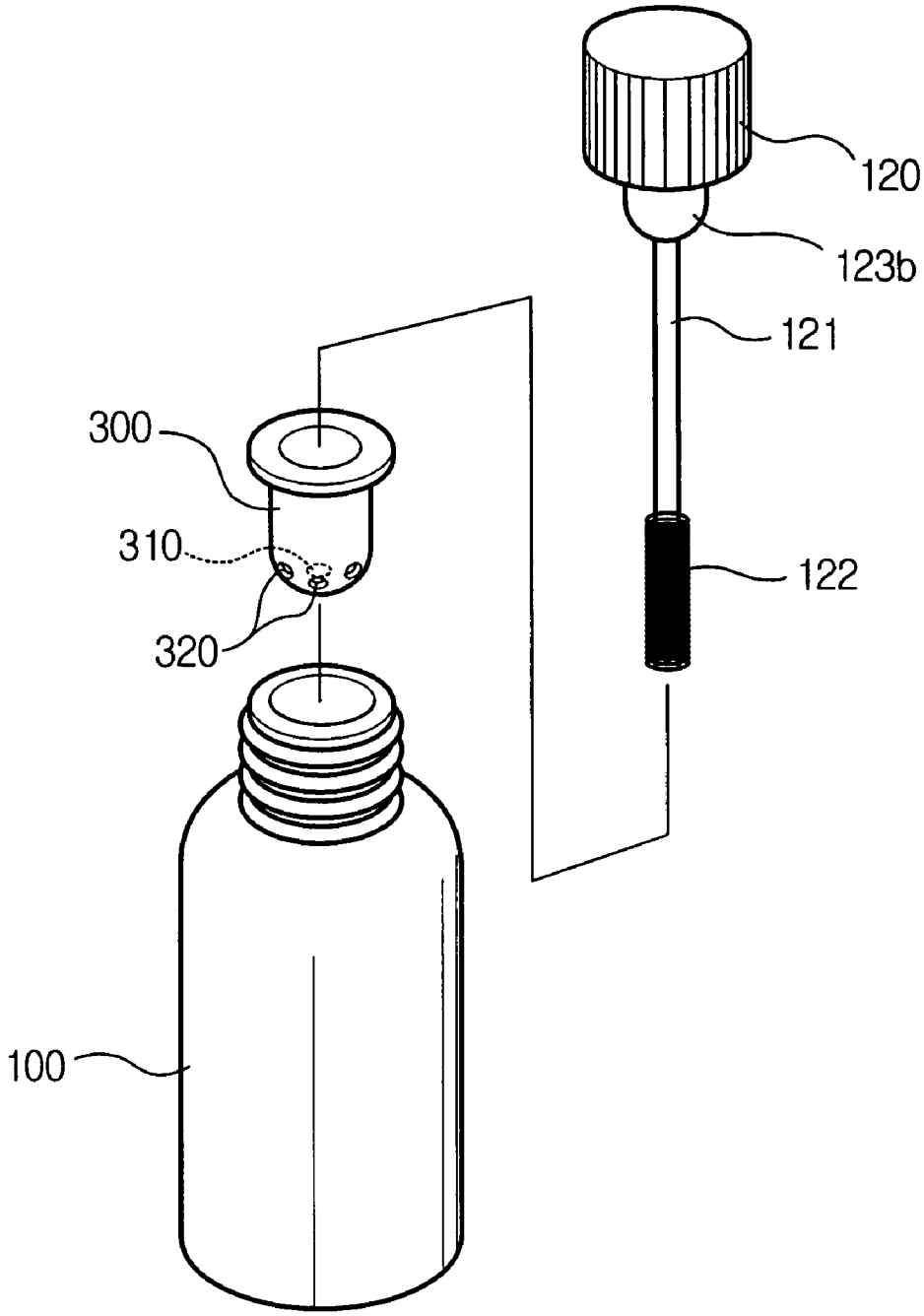
FIG. 8 is an exploded perspective view of a cosmetic vessel, according to a second embodiment of the present invention.
Figure 9:
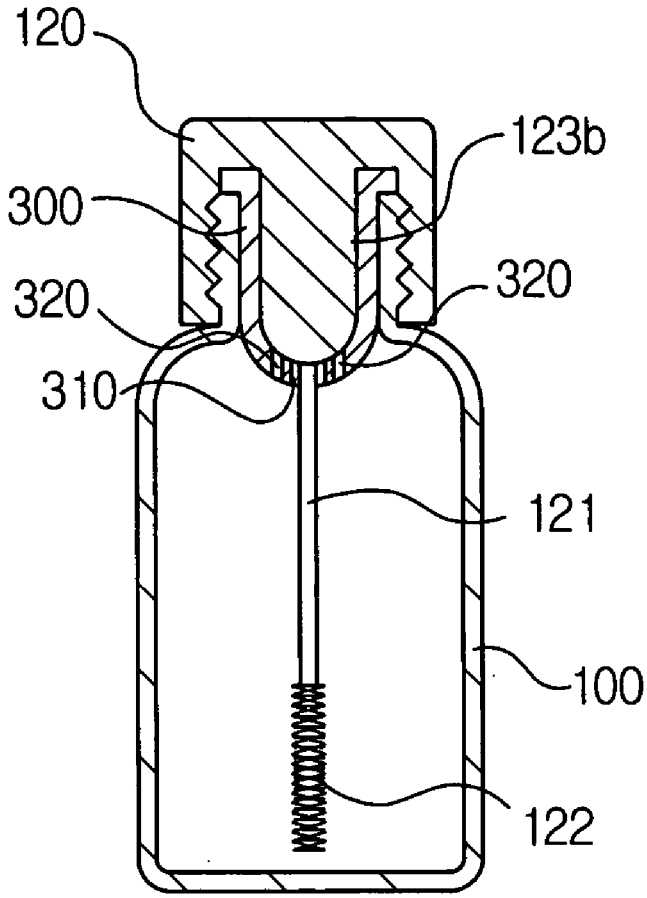
FIG. 9 is a sectional view of the cosmetic vessel of FIG. 8.

Referring to FIG. 8, there is shown an exploded perspective view of a cosmetic vessel, according to a second embodiment of the present invention. FIG. 9 is a sectional view of the cosmetic vessel of FIG. 8, and FIG. 10 is a bottom plan view of a plug packing, in the cosmetic vessel of FIG. 8.

As shown in the above drawings, the cosmetic vessel includes a vessel body 100 containing a cosmetic solution while an upper portion thereof is open, and a plug packing 300 fitted into the upper portion of the vessel body 100 and having a passage hole 310 in a center of a bottom thereof and at least one vent hole 320 formed around the passage hole 310. Further, the cosmetic vessel has a cap 120 having an internally threaded circumference to be threadably engaged to an externally threaded circumference of the upper portion of the vessel body 100, in which the cap 120 has a shaft 121 extending downwardly therefrom, a brush 122 provided to a lower end of the shaft 121, and a closing part 123*b* fitted therein and formed in a hemispherical shape at its lower end.

The passage hole 310 of the plug packing 300 functions to allow the cosmetic solution to uniformly adhere around the brush 122 of the cap 120, upon removing the brush 122 of the cap 120 from the vessel body 100. Thus, the user can easily apply the cosmetic solution to desired body parts, such as eyelashes.

Figure 10:
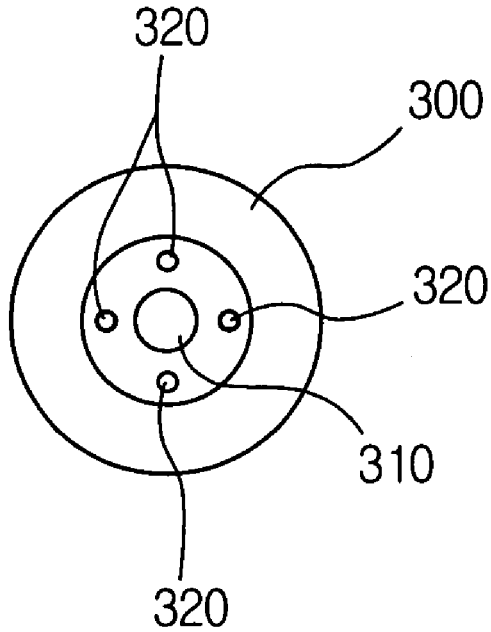
FIG. 10 is a bottom plan view of a plug packing, as a main constitutive part of the cosmetic vessel of FIG. 8.

In addition, as seen in FIG. 10, one or more vent holes 320 are formed around the passage hole 310 of the plug packing 300, and the number thereof is not limited.

As for the cosmetic vessel according to the second embodiment of the present invention, the cap 120 opens from the vessel body 100, whereby the cap 120 is separated from the vessel body, so as for the beauty care of the eyelashes or lips of the user. When the brush 122 of the cap 120 is removed from the vessel body 100, the cosmetic solution adhering to the brush 122 of the cap 120 is also taken out of the vessel body 100 and is eventually applied to face of the user. Upon the removal of the cap 120 which covers the upper portion of the vessel body 100 from the vessel body 100, since air is introduced through a plurality of vent holes 320 provided around the center of the bottom of the plug packing 300, the cosmetic solution can easily adhere to the brush 122 of the cap 120.

After the beauty care of the eyelashes or lips of the user is finished using the cosmetic solution adhering to the brush 122 of the cap 120, the cap 120 is threadably fastened again to the upper portion of the vessel body 100. Thereby, the vent holes 320 of the plug packing 300, serving to circulate air, are completely blocked by the closing part 123*b* of the cap 120. Hence, the air is not introduced into the vessel body 100, whereby the cosmetic solution in the vessel body 100 is prevented from deterioration and solidification.

Figure 11:
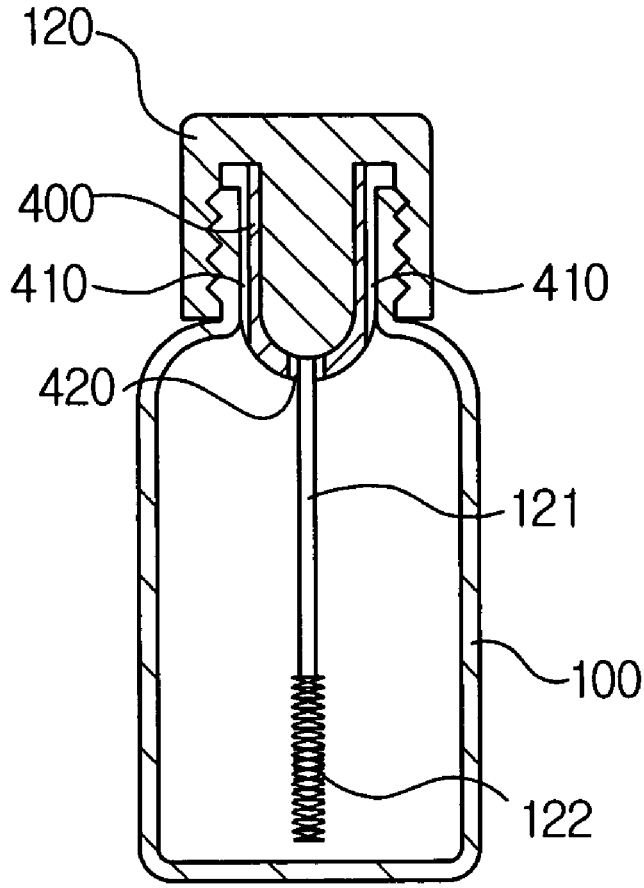
FIG. 11 is a sectional view of a cosmetic vessel, according to a third embodiment of the present invention.
Figure 12:
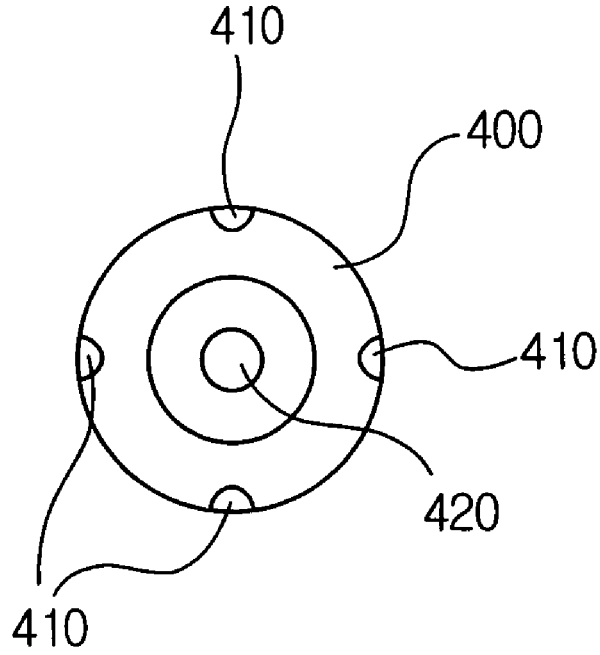
FIG. 12 is a bottom plan view of a plug packing, as a main constitutive part of the cosmetic vessel of FIG. 11.

Turning now to FIG. 11, a cosmetic vessel, according to a third embodiment of the present invention, is shown. FIG. 12 is a bottom plan view of a plug packing of the cosmetic vessel of FIG. 11. As shown in the above drawings, the plug packing 400 comprises a passage hole 420 in a center of a bottom thereof to allow a shaft 121 and a brush 122 of a cap 120 to be placed into or removed from a vessel body 100, and at least one vent channel 410 formed at an outer surface of the plug packing 400. A plurality of the vent channels 410 are longitudinally provided on the outer surface of the plug packing 400, as shown in FIG. 12. That is, the vent channels 410 extend from the upper end of the plug packing 400 to the lower end of the plug packing 400 positioned at an inside of the vessel body 100.

In this case, the vent channels 410 formed around the plug packing 400 have functions equal to the vent holes 320 formed at the lower end of the plug packing 300 of the cosmetic vessel in the above second embodiment, and thus, the description therefor is omitted.

As described above, the present invention provides a cosmetic vessel, characterized in that air can efficiently circulate by means of vents provided to the plug packing, whereby the cosmetic solution can easily adhere to the brush of the cap. Further, when the cap is closed, the vents are completely blocked, thus preventing the cosmetic solution from deterioration or solidification.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A cosmetic vessel, comprising:

a vessel body;

a cap threadedly engaged to an upper portion of the vessel body, the cap including:

a closing part at one end of the cap, the closing part having a hollow interior, a shaft extending downwardly from the closing part, the shaft having an upper end be fitted in the hollow interior of the closing part, and a brush provided at a lower distal end of the shaft; and a plug packing fitted into an upper portion of the vessel body, the plug packing including:

a lower edge, a plurality of L-shaped walls extending down from the lower edge, the L-shaped walls each having an axial leg component and a transverse leg component a plurality of vent openings formed between side edges of both the axial leg component and the transverse leg component when the plug packing is fitted into the upper portion of the vessel body, the vent openings being present in an unbiased condition of the L-shaped walls when the brush is not inserted therethrough, and a central passage hole of a predetermined diameter defined between radially inner edges of the L-shaped walls to allow the shaft and the brush of the cap to be placed into or removed from the vessel body.

* * * * *